US005295419A

United States Patent [19]

Denning

[11] Patent Number: 5,295,419

[45] Date of Patent: Mar. 22, 1994

[54] PRY DEVICE ADAPTED FOR REMOVING CONTAINER LIDS

[76] Inventor: Donald L. Denning, 6730 Indiana St., Golden, Colo. 80403

[21] Appl. No.: 985,597

[22] Filed: Dec. 3, 1992

[51] Int. Cl.[5] ..... B67B 7/14

[52] U.S. Cl. ..... 81/3.37; 81/3.55

[58] Field of Search ..... 81/3.55, 3.56, 3.36, 81/3.37, 3.07

[56] References Cited

U.S. PATENT DOCUMENTS

| | | | |
|---|---|---|---|
| D. 145,647 | 9/1946 | Stewart | 81/3.57 |
| 961,224 | 6/1910 | Fische | 81/3.55 |
| 4,881,432 | 11/1989 | Olorenshaw | 81/3.55 |

FOREIGN PATENT DOCUMENTS

| | | | |
|---|---|---|---|
| 0349572 | 3/1922 | Fed. Rep. of Germany | 81/3.55 |
| 0897062 | 6/1953 | Fed. Rep. of Germany | 81/3.55 |
| 0699731 | 11/1953 | United Kingdom | 81/3.55 |

*Primary Examiner*—Roscoe V. Parker
*Attorney, Agent, or Firm*—Timothy J. Martin; Carl Schaukowitch

[57] ABSTRACT

A pry device adapted for removing a lid from a container comprises a first lever member, a second lever member and a fulcrum element interconnecting the first and second lever members for relative pivotal movement therebetween. The first lever member has a first handle portion and a first lip portion opposite the first handle portion. The first lip portion is configured to engage an edge portion of the lid when the lid is secured to the container. The second lever member has a second handle portion and a second lip portion opposite the second handle portion. The second lip portion is configured to engage a flange on the container. The first and second lip portions are movable between a contracted position and an expanded position. In the contracted position, the first and second lip portions are at a first distance sufficiently to respectfully engage the edge portion of the lid and the flange. In the expanded position, the first and second lip portions are separated a second distance greater than the first distance while respectfully engaged with the edge portion of the lid and the flange. The first and second lip portions are operative to exert a prying force between the edge portion of the lid and the flange thereby removing the lid from the container when the first and second lip portions are moved from the contracted position to the extended position.

22 Claims, 3 Drawing Sheets

PRY DEVICE ADAPTED FOR REMOVING CONTAINER LIDS

FIELD OF THE INVENTION

This invention relates to a pry device adapted for removing a lid from a container. More particularly, this invention relates to a pry device for removing a lid from a container having an upper rim on which the lid is releasably secured and a flange extending outwardly from the container proximate to the upper rim.

BACKGROUND OF THE INVENTION

In today's world, containers are commonly package a variety of items. For example, in the restaurant industry, some bulk food items such as pickles or flour are delivered to restaurants in five-gallon pails made from high density polyethylene plastic. Even maintenance supplies such as powered detergents or liquid solvents necessary to maintain a clean kitchen in a restaurant are delivered in plastic containers of varying sizes. These containers are also employed to package paints, stains, caulks, chemicals and the like. In many instances, plastic containers have replaced glass containers primarily because plastic is lighter in weight and much more resistant to breakage.

Generally, this bulk type of container described above is constructed as a bucket or a pail having an upright wall which terminates in an upper rim and has a flange extending outwardly from the upright wall at a location proximate to the upper rim. Typically, a lid is provided with the container, and the lid has a collar which is releasably secured to the upper rim of the container to prevent spillage of the items if the container is upset or otherwise jostled. Sometimes, a wire handle is attached at opposed positions on the flange to facilitate the ease of carrying the container.

A problem associated with these types of plastic containers is the difficulty in removing the lid from the container. A screwdriver or crowbar can be used to pry the collar of the lid away from the rim of the container. A can opener-type device can also be used to remove the lid from the container. This can opener-type device has a claw extending from a handle portion. One end of the claw engages an edge portion of the collar of the lid while the other claw portion engages the top of the lid. Exerting a force on the handle portion of the can opener device causes the collar to be pried away from the rim.

Often, these methods of removing the lid from the container damages the lid and its collars. Sometimes, even the rim of the container is damaged. Additionally, these methods are often difficult and time-consuming. Damaging the lid and the container could be disadvantageous. For example, if paint was provided in this container, a damaged lid or rim could result in air entering into the container having residual paint. Exposing paint to air will eventually cause this paint to dry out and render it unusable for future use. Furthermore, there is a strong movement today to recycle products when possible. If a lid is damaged upon its removal, a new lid must be provided to recycle the old container. If both the lid and the container are damaged, they could not be recycled and both would have to be discarded after use.

Therefore, a need exists to provide an improved device for removing a lid from a container of the type as described above so that a lid can be removed from the container without damaging either the lid or the container. It is from these considerations and others that the present invention has evolved.

SUMMARY OF THE INVENTION

It is an object of the present invention to provide a new and useful pry device to remove a lid from a container of a type having a flange located proximate to the lid without damaging either the lid or the container.

It is yet another object of the present invention to provide such a pry device that is adjustable to adapt to different containers having different distances between its flange and the lid secured onto the container.

It is yet a further object of the present invention to provide such a pry device that significantly increases the mechanical advantage over the prior art devices for easy removal of the lid.

A still further object of the present invention is to provide such a pry device which is easy to manufacture and simple to use.

In its broadest form, the pry device is adapted for removing a lid from a container of a type having an upright wall terminating in an upper rim on which a collar of the lid is releasably secured and having a flange extending outwardly from the upright wall proximate to the upper rim. Generally, the pry device comprises a first lever member, a second lever member and a fulcrum element interconnecting the first and second lever members for relative pivotal movement therebetween. The first lever member has a first handle portion and a first lip portion opposite the first handle portion. The first lip portion is configured to engage an edge portion of the collar of the lid when the lid is secured to the container. The second lever member has a second handle portion and a second lip portion opposite the second handle portion. The second lip portion is configured to engage the flange on the container. The fulcrum element interconnects the first and second lever members for relative pivotal movement therebetween so that the first and second lip portions ar movable between a contracted position and an expanded position. In the contracted position, the first and second lip portions are separated a first distance sufficient to respectfully engage the edge portion of the collar of the lid and the flange. In the expanded position, the first and second lip portions are separated a second distance greater than the first distance while respectfully being engaged with the edge portion of the collar of the lid and the flange. When moving between the contracted position and the expanded position, the first and second lip portions are operative to exert a prying force between the edge portion of the collar of the lid and the flange thereby removing the edge portion of the collar of the lid from the upper rim of the container when the first and second lip portions are moved from the contracted position to the expanded position.

The fulcrum element may be formed so that it is located proximate to the upright wall of the container when the first and second lip portions respectfully engage the edge portion of the collar of the lid and the flange. In one embodiment, the fulcrum element extends substantially parallel to and alongside the upright wall of the container. The fulcrum element may include either a single arm which may extend through a slot in one of the lever members or a pair of arms disposed in a substantially parallel spaced-apart relationship to receive a lever member therebetween. The fulcrum element can be rigidly attached to one of either the first or second handle portions of the respective first or second lever members. The fulcrum element can also be rigidly attached to one of either the first or second lip portions of the respective first or second lever members. Further, the fulcrum element could be rigidly attached to one of either the first or second handle portions of the respective first and second lever members and to one of a corresponding first and second lip portions of the respected first and second lever members.

The relative pivotal movement between the first and second lever members is achieved by a pivotal connection means. The pivotal connection means has a pivotal connection point whereat the fulcrum element and the first lever member are pivotally connected. The pivotal connection point is located substantially within a plane defined by the collar of the lid of the container so that when the first lip portion moves from the first distance to the second distance, the first lip portion and the edge portion of the collar commence movement in a direction substantially tangential to an imaginary radius between the first lip portion engaged with the edge portion of the collar and the pivotal connection point. The pivotal connection point is movable along the fulcrum element member to adjust the pivotal connection point into a position within the plane defined by the collar of the lid of the container. Thus, the pry device can be adjusted to accommodate different relative spacings between the lid and flange. Also, the imaginary radius is adjustable by moving the pivotal connection point along the first lever member. Thus, the pry device can be further adjusted to accommodate different relative spacings between the pivotal connection point and the lid.

The pivotal connection means includes in a releasable connector adapted to releasably connect the fulcrum element and one of either the first or second lever members. The releasable connector can be hitch pin.

The first and second lip portions can be configured in various shapes. For example, when the first and second lip portions are respectfully engaged with the edge portion of the collar and the flange, the first and second lip portions can be configured in a common contour to correspond to the upright wall of the container and respectfully with the edge portion of the collar and the flange. For one exemplary embodiment of the present invention, the first lip portion includes a flattened bar section having a bar edge which substantially engages the edge portion of the collar of the lid and the second lip portion includes a flattened plate section when engaging the flange of the container. In another exemplary embodiment of the present invention, the first and second lip portions include a substantially flat plate as the first and second lip portions are respectfully engaged with the edge portion of the collar and the flange. In another exemplary embodiment of the present invention, the first lip portion includes a U-shaped channel section which, upon engagement, receives the edge portion of the collar of the lid and the second lip portion includes a substantially square bar section when engaged with the flange of the container.

Yet another exemplary embodiment of the present invention is particularly useful where space is at the premium. This pry device includes a first lever member, a second lever member, a linkage element and a fulcrum element. The first lever member has a first handle portion and a first lip portion opposite the first handle portion. The first lip portion is configured to engage an edge portion of the collar of the lid when the lid is releasably secured to the container. The second lever has a second handle portion and a second lip portion located opposite the second handle portion and configured to engage the flange on the container. The second lever member is pivotally connected to the first lever member at the first and second handle portions proximate to the first and second lip portions. The linkage element has a first linkage end portion pivotally connected to the first handle portion of the first lever member at a location opposite the first lip portion. The linkage element also has a second linkage end portion located opposite the first linkage end portion. The fulcrum element has a fulcrum handle portion and a first fulcrum end portion located opposite the fulcrum handle portion. The fulcrum element is pivotally connected to the linkage element at the second linkage end portion and to the second lever member at a location opposite the second lip portion and proximate to the first fulcrum end portion. Now, by actuating the fulcrum handle portion of the fulcrum element, the first and second lip portions move between a contracted position and an expanded position. In the contracted position, the first and second lip portions are separated a first distance sufficient to respectfully engage the edge portion of the collar of the lid and the flange. In the expanded position, the first and second lip portions are separated a second distance greater than the first distance. The first and second lip portions are operative to exert a prying force between the edge portion of the collar of the lid and the flange thereby removing the edge portion of the collar of the lid from the upper rim of the container when the first and second lip portions are moved from the contracted position to the expanded position.

These and other objects of the present invention will become more readily appreciated and understood from a consideration of the following detailed description of the preferred embodiment when taken together with the accompanying drawings, in which:

DESCRIPTION OF THE EXEMPLARY EMBODIMENT

In its broadest sense, the present invention is a a pry device adapted for removing a lid from a container. Although the container can be made from various materials and be constructed in configurations other than cylindrical, the container is of a type that has an upright wall terminating in an upper rim on which a collar of the lid is releasably secured. The upright wall also has a flange extending outwardly therefrom at a location proximate to the upper rim of the container. Generally, the pry device includes a first lever member, a second lever member and a fulcrum element interconnecting the first and second lever members for relative pivotal movement therebetween. The first lever member has a first lip portion and a second lever member has a second lip portion. At a contracted position, the first and second lip portions are separated a first distance sufficient to respectfully engage the lid and the flange. In an expanded position, the first and second lip portions are separated a second distance greater than the first distance. Moving the first and the second lip portions between the contracted position and the expanded position operates to exert a prying force between the lid and the flange thereby removing the lid from the container. It should be apparent to those skilled in the art that various embodiments of the present invention may be employed without departing from the spirit thereof. What follows, however, is a description of five exemplary embodiments of the present invention.

Figure 1:
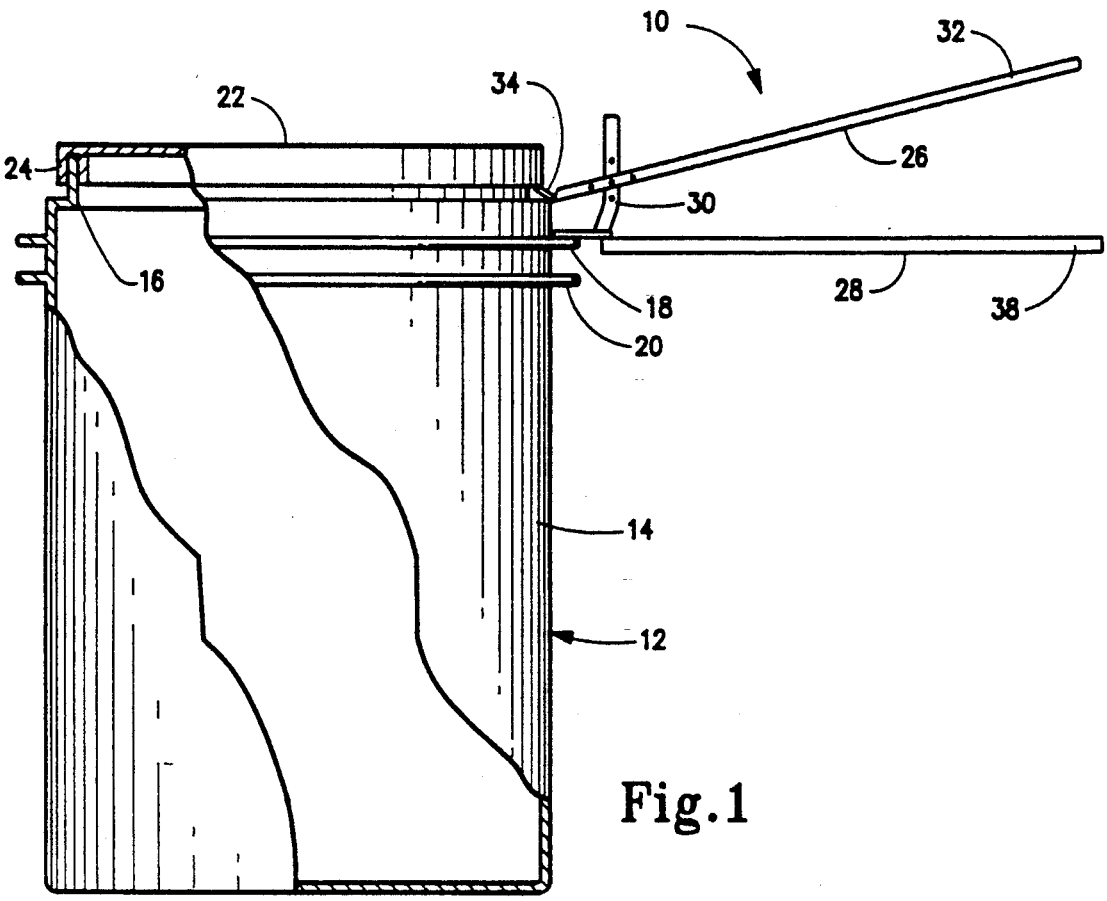
FIG. 1 is a side view of a pry device according to the first exemplary embodiment of the present invention and showing the pry device operably engaging a container which in turn is shown partially broken away.
Figure 2:
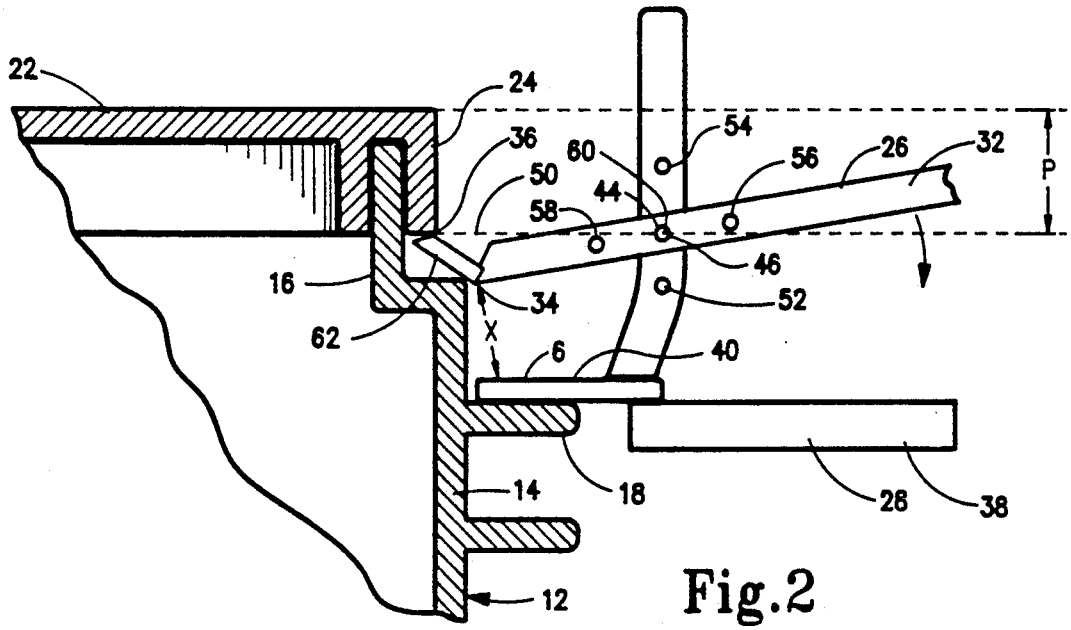
FIG. 2 is an enlarged side view shown in cross-section of the pry device of FIG. 1 operably engaged in a contracted position with the container.
Figure 3:
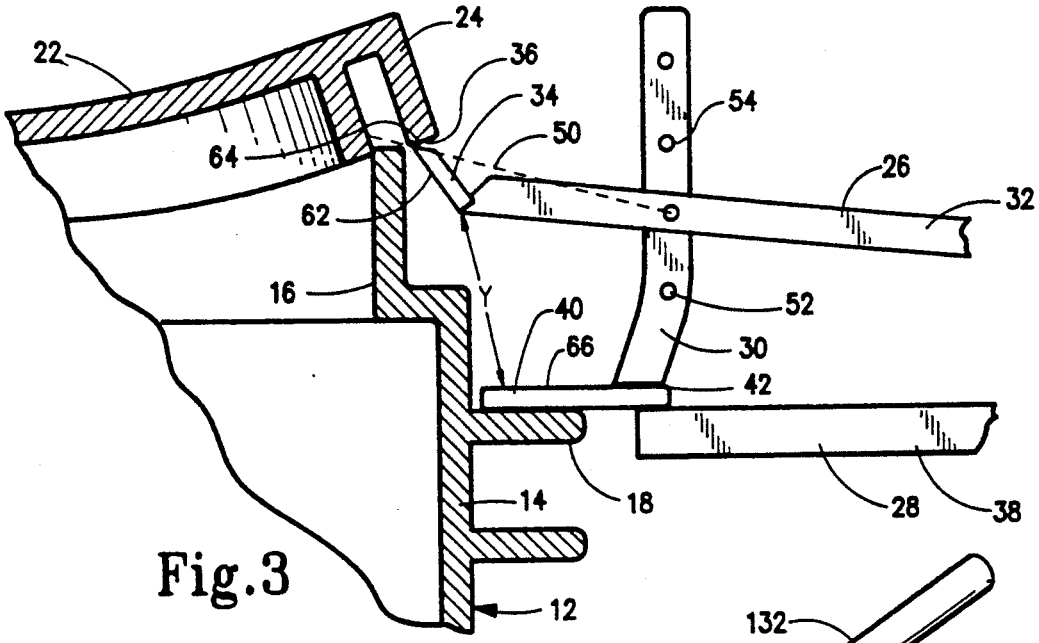
FIG. 3 is a view shown similar to FIG. 2 but showing the pry device in an expanded position for removing the lid from the container in FIG. 2.

A pry device according to a first exemplary embodiment of the present invention is shown in FIGS. 1-3. Here, pry device 10 is shown operably engaged with a standard type container 12. The container 12 is of a type that has an upright wall 14 which terminates in an upper rim 16. A flange 18 and a secondary flange 20 extend outwardly from the upright wall 14 proximate to the rim upper 16. The container 12 also includes a lid 22 which has a collar 24 which releasably secures the lid 22 onto the upper rim 16 of the container 12. The pry device 10 of the present invention is adapted for removing the lid 22 from containers of the general type of container 12 or other such containers having similar structural features.

The pry device 10 shown in FIGS. 1-3 includes a first lever member 26, a second lever member 28, and a fulcrum element 30 which interconnects the first and second lever members 26, 28 respectively for relative pivotal movement therebetween. The first lever member 26 has a first handle portion 32 formed from square metal tubing, but other shapes and material could be employed. A first lip portion 34 is located opposite the first handle portion 32, and first lip portion 34 is configured to engage an edge portion 36 of the collar 24. The second lever member 28 has a second handle portion 38 again formed from square metal tubing. A second lip portion 40 is located opposite the second handle portion 38, the second lip portion 40 is configured to engage the flange 18 on the container 12.

Fulcrum element 30 interconnects the first and second lever members 26, 28 respectively for relative pivotal movement therebetween so that first and second lip portions 34, 40 respectively, are movable between a contracted position as best shown in FIG. 2 and an expanded position as best shown in FIG. 3. In the contracted position, the first and second lip portions 34 and 40 respectively, are separated a first distance "X" which is sufficient to respectfully engage the edge portion 36 of the collar 24 of the lid 22 and the flange 18. In the expanded position, the first and second lip portions 34 and 40 are separated a second distance "Y" which is greater than the first distance "X". When moved between the contracted position and the expanded position while the first and second lip portions 34 and 40 respectively are engaged with the edge portion 36 of the collar 24 of lid 22 and the flange 18, the first and second lip portions 34 and 40 are operative to exert an prying force between the edge portion 36 of the collar 24 of the lid 22 and the flange 18 thereby removing the edge portion 36 of the collar 24 of the lid 22 from the rim 16 of the container 12. This is best shown by viewing FIGS. 2 and 3 sequentially. Mechanical advantage is obtained for the expansion of the distance between the lip portions 34 and 40 as a result of the leverage of lever members 26, 28 acting on fulcrum element 30.

When the first and second lip portions 34 and 40 respectively engage the edge portion 36 of the collar 24 of the lid 22 and the flange 18, the fulcrum element 30 is located proximate the the upright wall 14 of the container 12. Furthermore, the fulcrum element 30 extends in a substantially parallel relationship to the upright wall 14 of the container 12 alongside the upright wall 14 at the upper rim 16. And for this exemplary embodiment of the present invention shown in FIGS. 1-3, the fulcrum element 30 is rigidly attached to the second lip portion 40 of the second lever member 28 by a weldment 42.

Relative pivotal movement between the first and second lever members 26 and 28 is achieved by a pivotal connection means 44. The pivotal connection means 44 has a pivotal connection point 46 whereat the fulcrum element 30 and a first lever member 26 are pivotally connected. The pivotal connection point 46 is located either within or substantially within a plane "P", as best shown in FIG. 2 defined by the collar 24 of the lid 22 of the container 12 so that when the first lip portion 34 moves from the first distance "X" to the second distance "Y", the first lip portion 32 and the edge portion 36 of the collar 24 commence movement in a direction substantially tangential to an imaginary radius 50 formed between the first lip portion 34 engaged with the edge portion 36 of the collar 24 and the pivotal connection point 46.

The pivotal connection point 46 is preferably adjustable along the fulcrum element 30 so that it can be adjusted into a position within the plane "P" defined by the collar 24 of the lid 22 of the container 12 to accommodate different relative spacing between the flange 18 and the edge portion 36 of the collar 24 of the lid 22. This can be achieved, for example, by moving the pivotal connection point 46 to either a first fulcrum element hole 52 or a second fulcrum element holes 54. Further, the imaginary radius 50 can also be adjusted by moving the pivotal connection point 46 along the first lever member 26 to either a first adjustment hole 56 or a second adjustment hole 58 to accommodate different relative spacing between the pivotal connection point 46 and the edge portion 36 of the collar 24 of the lid 22. The pivotal connection means 44 includes a releasably connector 60 which is adapted to releasably connect the fulcrum element 30 and the first lever member 26. The releasable connector 60 can be any conventional hitch pin, rivet, bolt or the like. Other structures as known in the art of pliers could be employed.

To optimize the design of the pry device 10, the first and second lip portions can be configured in a common contour to correspond to the perimeter of upright wall 14 of the container 12 and respectively with the edge portion 36 of the collar 24 and the flange 18. This configuration is quite useful when the first and second lip portions 32 and 34 respectively are engaged with the edge portion 36 of the collar 24 and the flange 18. As best shown in FIGS. 2 and 3, the first lip portion 34 of the first lever member 26 includes a first flattened plate section 62 and the second lip portion 40 includes a second flattened plate section 64 when engaging the flange 18 of the container 12.

Figure 4:
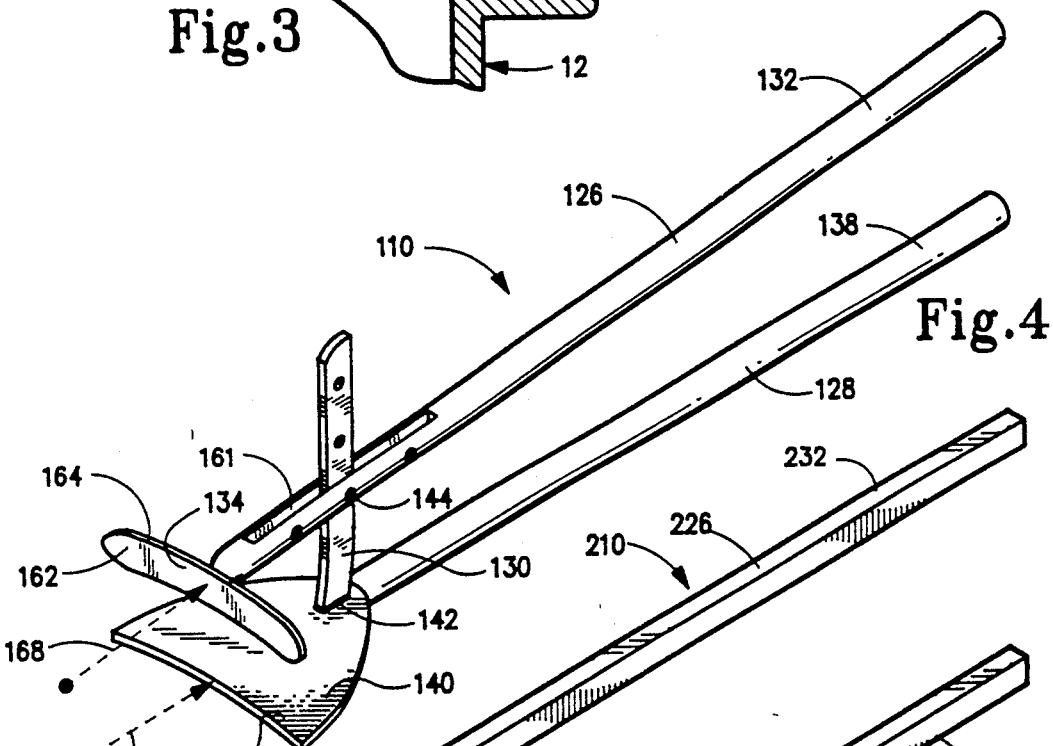
FIG. 4 is a perspective view of a second exemplary embodiment of the present invention.

In FIG. 4, a second exemplary embodiment of a pry device 110 is shown. The second exemplary embodiment of the pry device 110 includes a first lever member 126, a second lever member 128 and a fulcrum element 130 interconnecting the first and second lever members 126 and 128 for relative pivotal movement therebetween. The first lever member has a first handle portion 132 formed from metal rod material and a first lip portion 134 which is located opposite the first handle portion 132. The second lever member 128 has a second handle portion 138 formed from metal rod material and a second lip portion 140 which is located opposite the second handle portion 138. The fulcrum element 130 is rigidly attached to the second lip portion 140 by a weldment 142. The first lever member 126 includes a slot 161 extending therethrough to receive the fulcrum element 130 for relative pivotal movement between the first and second lever members 126 and 128. For this first alternative exemplary embodiment of the present invention, the first lip portion 134 includes a flattened bar section 162 having a bar edge 164 which substantially engages the edge portion 36 of the collar 24 of the lid 22 and the second lid portion 140 includes a flattened plate section 166 when engaging the flange 18 of the container 12. Note that the first and second lip portion 134 and 138 are configured in a common contour to correspond to the upright wall 14 of container 12 and respectfully with the edge portion 36 of the collar 24 and the flange 18. Thus, where container 12 is cylindrical, it would be advantageous that the first and second lip portions 134 and 138 be configured in a common contour as a curve with a radius 168 to correspond to the radius of curvature of upright wall 14. The first handle portion 132 is connected to the fulcrum element 130 for pivotal movement between the first and second lever members 126 and 128 by a pivotal connection means 144 which has been described in detail hereinabove.

Figure 5:
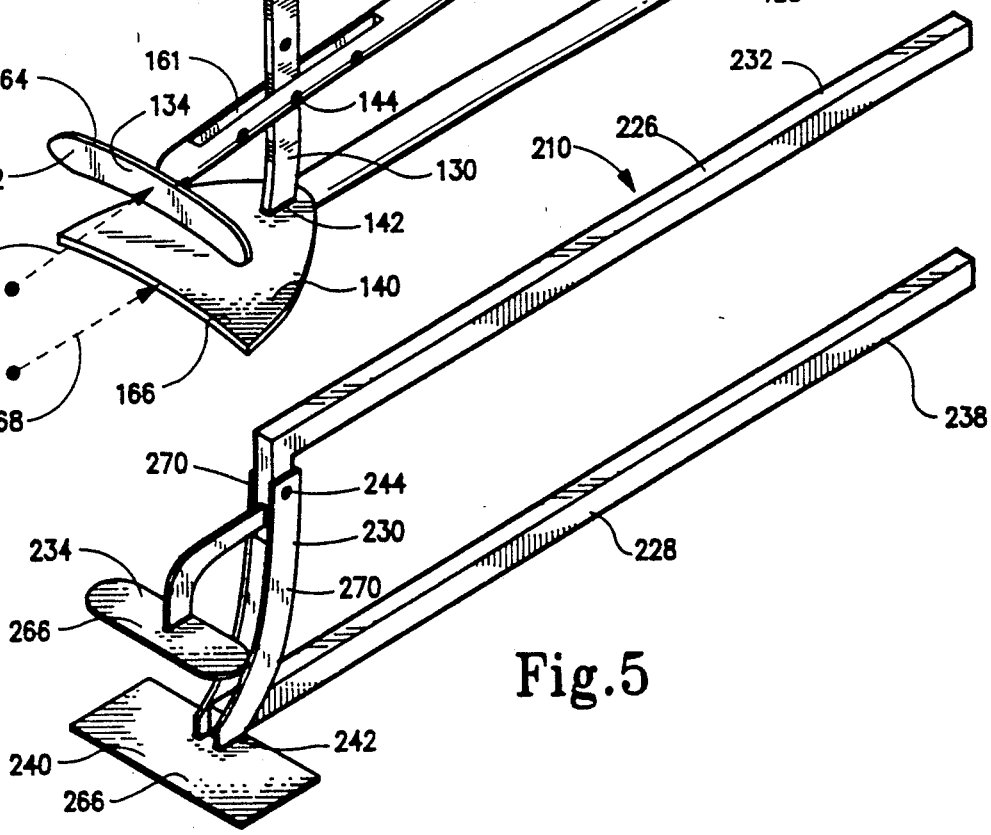
FIG. 5 is a perspective view of a third exemplary embodiment of the present invention.

FIG. 5 depicts a third exemplary embodiment of a pry device 210 of the present invention. The pry device 210 includes a first lever member 226, a second lever member 228 and a fulcrum element 230 interconnecting the first and second lever members 126 and 128 for relative pivotal movement therebetween. The first lever member 226 has a first handle portion 232 formed from square bar stock and a first lip portion 234 located opposite the first handle portion 232. The second lever member 228 has a second handle portion 238 formed from square bar stock and a second lip portion 240 located opposite the second handle portion 238. The fulcrum element 230 is forked and includes a pair of arms 270 disposed in a substantially parallel spaced-apart relationship. At one end, the fulcrum element 130 is rigidly attached to the second handle portion 238 and the second lip portion 240 of the second lever member 228 by a weldment 242. The first and second lip portions 234 and 240 include a substantially flattened plate 266 as the first and second lip portions 234 and 240 are respectfully engaged with the edge portion 36 of the collar 24 and the flange 18. Relative pivotal movement between the first and second lever members 226 and 228 is achieved by a pin or bolt pivotal connection means 244 whereby the first handle portion 232 of the first lever member 226 is received between the spaced-apart pair of arms 270 for pivotal connection.

Figure 6:
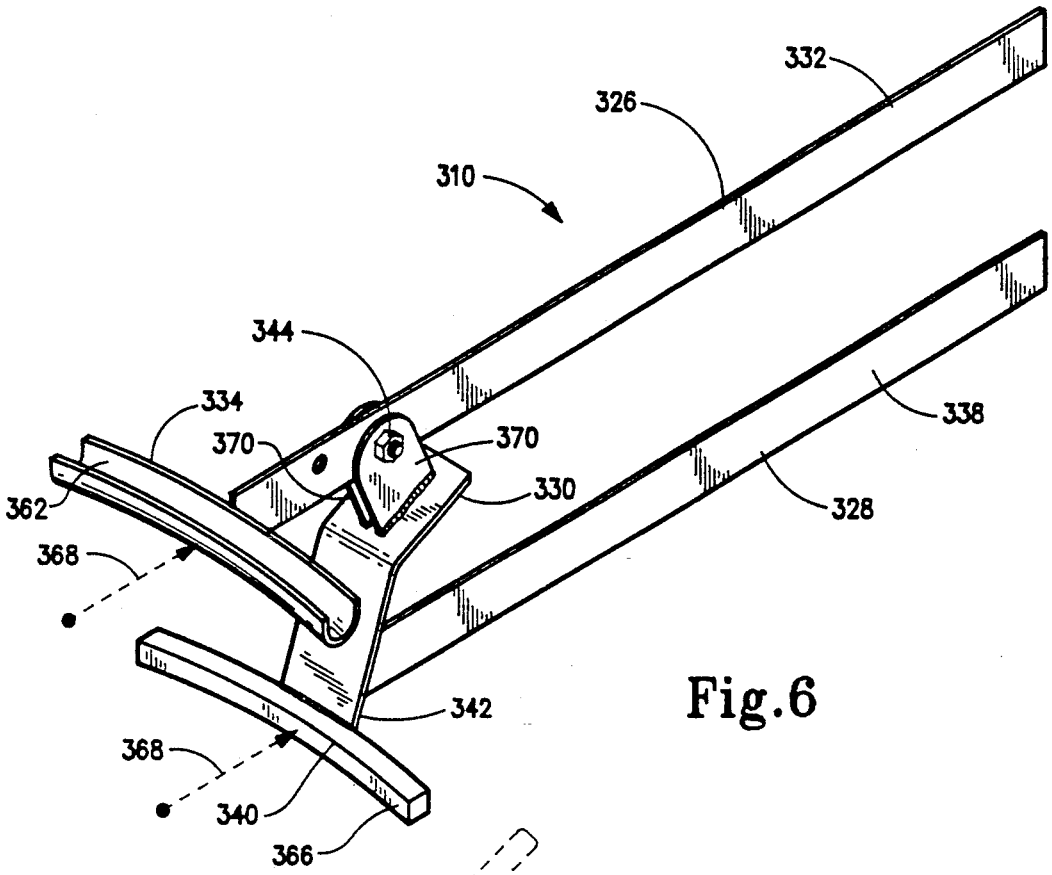
FIG. 6 is a perspective view of a fourth exemplary embodiment of the present invention.

FIG. 6 depicts a fourth exemplary embodiment of a pry device 310. The fourth exemplary embodiment of the pry device 310 includes a first lever member 326, a second lever member 328 and a fulcrum element 330 which interconnects the first and second lever members 326 and 328 for relative pivotal movement therebetween. The first lever member 326 has a first handle portion 332 formed from rectangular metal bar stock and a first lip portion 334 is located opposite the first handle portion 332. The second lever member 328 has a second handle portion 338 also formed as a rectangular metal bar and a second lip portion 340 located opposite the second handle portion 338. The fulcrum element 330 is rigidly attached to the second handle portion 338 of the second lever member 328. The second lip portion 340 is rigidly attached to the fulcrum element 330 by a weldment 342. A portion of the fulcrum element 330 includes a pair of rigid arms 370 disposed in a substantially parallel spaced-apart relationship. Relative pivotal movement between the first and second lever members 326 and 328 is achieved by a belt or pin 344. Here, however, the first lip portion 334 includes a U-shaped channel section 362 which upon engagement, receives the edge portion 36 of the collar 24 of the lid 22 and the second lip portion 340 includes a substantially square bar section 366 when engaged with the flange 18 of the container 12. The first and second lip portions 334 and 340 can be configured in a common contour to correspond to the upright wall 14 of the container 12. Having a circumferential upright wall 14, it would be advantageous that the first and second lip portions 334 and 340 be formed with a radius 368 to configure in a common contour with the circumferential upright wall 14.

Figure 7:
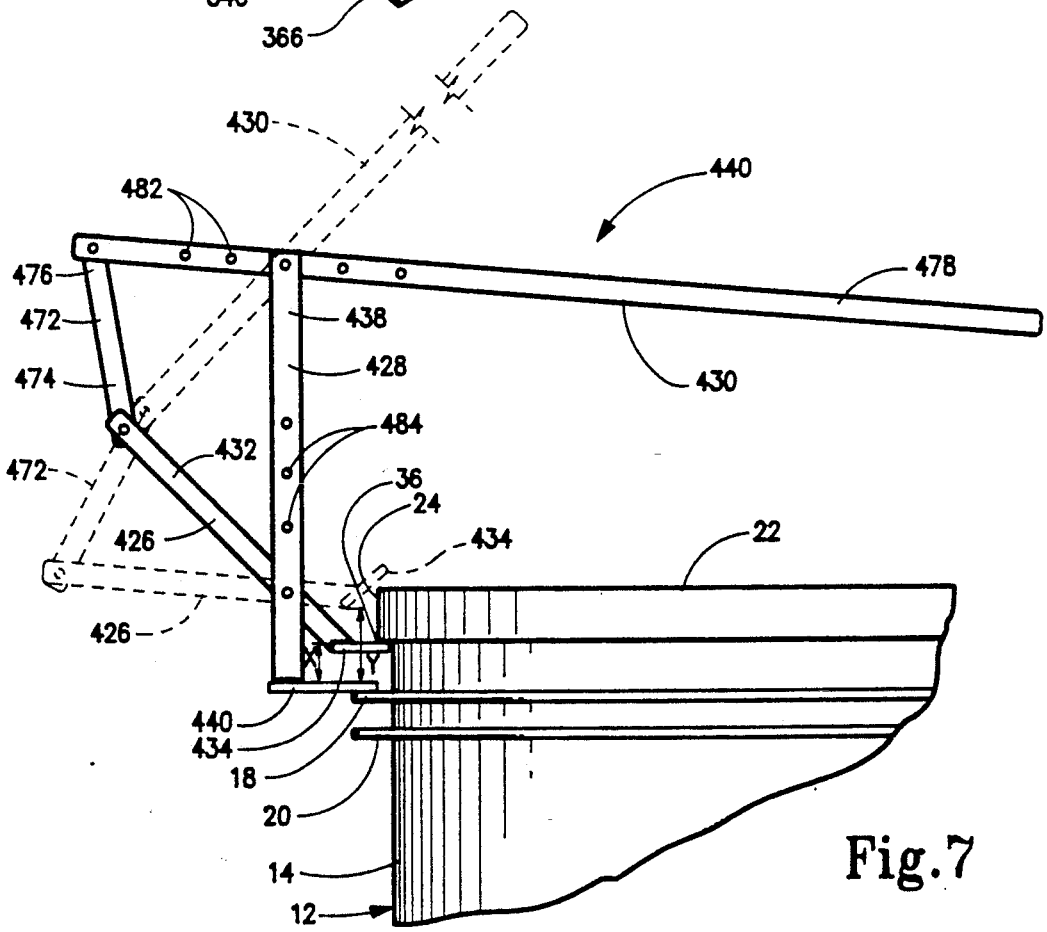
FIG. 7 is a side elevational view of a fifth exemplary embodiment of the present invention.

In FIG. 7, yet a fifth exemplary embodiment of a pry device 410 is depicted. This embodiment is particularly useful where space is at a premium. The pry device 410 here includes a first lever member 426, a second lever member 428, a linkage element 472 and a fulcrum element 430. The first lever member 426 has a first handle portion 432 and a first lip portion 434 located opposite the first handle portion 432. The first lip portion 434 is configured to engage an edge portion 36 of the collar 24 of the lid 22 when the lid 22 is releasably secured to the container 12. The second lever member 428 has a second handle portion 438 and a second lip portion 440 located opposite the second handle portion 438. The second lever member 428 is pivotally connected to the first lever member 426 at the first and second handle portions 432 and 438 proximate the first and second lip portions 434 and 440. The second lip portion 440 is configured to engage the flange 18 on the container 12. The linkage element 472 has a first linkage end portion 474 pivotally connected to the first handle portion 432 of the first lever member 426 opposite the first lip portion 434. The linkage element 472 also has a second linkage end portion 476 located opposite the first linkage end portion 474.

The fulcrum element 430 has a fulcrum handle portion 478 and a first fulcrum end portion 480 located opposite the fulcrum handle portion 478. The fulcrum element 430 is pivotally connected to the linkage element 472 at the second linkage end portion 476 and to the second lever member 428 opposite the second lip portion 440 and proximate the first fulcrum end portion 480 so that by actuating the fulcrum handle portion 478 of the fulcrum element 430, the first and second lip portions 434 and 440 move between a contracted position and an expanded position. In the contracted position, the first and second lip portions 434 and 440 are separated a first distance "X'" sufficient to respectfully engage the edge portion 436 of the collar 24 of the lid 22 and the flange 18. In the expanded position, the first and second lip portions 434 and 440 are separated a second distance "Y'" greater than the first distance "X'" while respectfully engaged with the edge portion of the collar 24 of the lid 22 and the flange 18. The first and second lip portions 434 and 440 are operative to exert a prying force between the edge portion 36 of the collar 24 of the lid 22 and the flange 18 thereby removing the edge portion of the collar 24 of the lid 22 from the rim 16 of the container 12 when the first and second lip portions 434 and 440 are moved from the contracted position to the expanded position. The pivotal connection between the first and second lever member 428 and the fulcrum arm 430 can be moved along the fulcrum element 430 by employing the alternate fulcrum elements holes 482. Further, the pivotal connection between the first lever arm member 426 and the second lever member 428 can be moved by employing the second lever member holes 484.

Since the operative fulcrum element handle extends directly over the lid, little room is needed to operate the pry device 410 while engaging the lip portions onto the collar and flange to detach the lid.

The pry device of the present invention can remove a lid simply and easily from a container without damaging either the lid or the container. The handle portions of the pry device can be extended for added mechanical advantage if desired. The adjustments on either or both of the first lever member and the fulcrum element can be employed to adapt the pry device to the distances between the collar of the lid and the flange of the container so that any various spacing differences among containers can be facilitated by one pry device.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A pry device adapted for removing a lid from a container of a type having an upright wall terminating in an upper rim on which a collar of the lid is releasably secured, the upright wall having a flange extending outwardly therefrom at a location proximate to the upper rim, comprising:

(a) a first lever member having a first handle portion and a first lip portion opposite said first handle portion, said first lip portion extending transversely with respect to said first handle portion so that said first lip portion projects laterally on either side of said first handle portion, said first lip portion being sized and configured to engage an edge portion of the collar when the lid is secured to the container;

(b) a second lever member having a second handle portion and a second lip portion opposite said second handle portion, said second lip portion extending transversely with respect to said second handle portion so that said second lip portion projects laterally on either side of said second handle portion, said second lip portion being sized and configured to engage the flange on the container; and (c) a fulcrum element interconnecting said first and second lever members for relative pivotal movement therebetween so that said first and second lip portions are movable between a contracted position wherein said first and second lip portions are alongside one another yet separated a first distance sufficient to respectively engage the edge portion of the collar of the lid and the flange and an expanded portion wherein said first and second lip portions are separated a second distance greater than said first distance, said first and second lip portions operative to exert a prying force between the edge portion of the lid and the flange thereby removing the edge portion of the collar of the lid from the rim of the container when the first and second lip portions are moved from said contracted position to said expanded position.

2. A pry device according to claim 1 wherein said fulcrum element is located proximate to the upright wall of the container when said first and second lip portions respectively engage the edge portion of the collar of the lid and the flange.

3. A pry device according to claim 2 wherein said fulcrum element extends substantially parallel to and alongside the upright wall of the container when said first and second lip portions respectively engage the edge portion of the collar of the lid and the flange.

4. A pry device according to claim 1 wherein said fulcrum element includes a pair of arms disposed in a substantially parallel spaced-apart relationship.

5. A pry device according to claim 1 wherein said fulcrum element is rigidly attached to one of said first and second handle portions of said respective first and second lever members.

6. A pry device according to claim 1 wherein said fulcrum element is rigidly attached to one of said first and second lip portions of said respective first and second lever members.

7. A pry device according to claim 1 wherein said fulcrum element is rigidly attached to one of said first and second handle portions of said respective first and second lever members and to one of a corresponding first and second lip portions of said respective first and second lever members.

8. A pry device according to claim 1 including a pivotal connection means for interconnecting said fulcrum element and one of said first and second lever members for relative pivotal movement therebetween.

9. A pry device according to claim 8 wherein said pivotal connection means includes a releasable connector adapted to releasably connect said fulcrum element and one of said first and second lever members.

10. A pry device according to claim 1 wherein said releasable connector is a hitch pin.

11. A pry device according to claim 1 wherein when said first and second lip portions are respectively engaged with the edge portion of the collar and the flange, said first and second lip portions are configured in a common contour to correspond to the upright wall of the container and respectfully with the edge portion of the collar and the flange.

12. A pry device according to claim 11 wherein each of said first and second lip portions includes a substantially flat plate as said first and second lip portions are respectfully engaged with the edge portion of the collar and the flange.

13. A pry device according to claim 11 wherein said first lip portion includes a flattened bar section having a bar edge which substantially engages the edge portion of the collar of the lid and said second lip portion includes a flattened plate section when engaging the flange of the container.

14. A pry device according to claim 11 wherein said first lip portion includes a U-shaped channel section which, upon engagement, receives the edge portion of the collar of the lid and said second lip portion includes a substantially square bar section when engaged with the flange of the container.

15. A pry device according to claim 1 wherein said first lever member includes a slot therethrough to receive said fulcrum element for relative pivotal movement between said first and second lever members.

16. A pry device adapted for removing a lid from a container of a type having an upright wall terminating in an upper rim on which a collar of the lid is releasably secured and the upright wall having a flange extending outwardly therefrom proximate to the rim, comprising:

(a) a first lever member having a first handle portion and a first lip portion opposite said first handle portion, said first lip portion being configured to engage an edge portion of the collar of the lid when the lid is releasably secured to the container;

(b) a second lever member having a second handle portion and a second lip portion opposite said second handle portion and being pivotally connected to said first lever member at said first and second handle portions proximate said first and second lip portions, said second lip portion being configured to engage the flange on the container;

(c) a linkage element having a first linkage end portion being pivotally connected to said first handle portion of said first lever member opposite said first lip portion and a second linkage end portion opposite said first end portion; and (d) a fulcrum element having a fulcrum handle portion and a first fulcrum end portion opposite said fulcrum handle portion, said fulcrum element being pivotally connected to said linkage element at said second end portion and to said second lever member opposite said second lip portion and proximate said first fulcrum end portion so that, by actuating said fulcrum handle portion of said fulcrum element, said first and second lip portions move between a contracted position wherein said first and second lip portions are separated a first distance sufficient to respectively engage the edge portion of the collar of the lid and the flange and an expanded position wherein said first and second lip portions are separated a second distance greater than said first distance, said first and second lip portions operative to exert a prying force between the edge portion of the collar of the lid and the flange thereby removing the edge portion of the collar of the lid from the upper rim of the container when the first and second lip portions are moved from said contracted position to said expanded position.

17. A pry device according to claim 16 including a pivotal connection means for interconnecting said second lever member to said first lever member, said linkage element to said first handle portion of said first lever member and to said fulcrum element and said fulcrum element to said second lever member.

18. A pry device adapted for removing a lid from a container of a type having an upright wall terminating in an upper rim on which a collar of the lid is releasably secured, the upright wall having a flange extending outwardly therefrom at a location proximate to the upper rim, comprising:

(a) a first lever member having a first handle portion and first lip portion opposite said first handle portion, said first lip portion being configured to engage an edge portion of the collar when the lid is secured to the container;

(b) a second lever member having a second handle portion and a second lip portion opposite said second handle portion, said second lip portion being configured to engage the flange on the container;

(c) a fulcrum element interconnecting said first and second lever members for relative pivotal movement therebetween so that said first and second lip portions are movable between a contracted position wherein said first and second lip portions are separated a first distance sufficient to respectively engage the edge portion of the collar of the lid and the flange and an expanded position wherein said first and second lip portions are separated a second distance greater than said first distance, said first and second lip portions operative to exert a prying force between the edge portion of the collar of the lid and the flange thereby removing the edge portion of the collar of the lid from the rim of the container when the first and second lip portions are moved from said contracted position to said expanded position; and (d) pivotal connection means for interconnecting said fulcrum element to a selected one of said first and second lever members at a pivotal connection point for relative pivotal movement therebetween, said pivotal connection point being movable along one of said fulcrum element and said selected one of said first and second lever members.

19. A pry device according to claim 18 wherein said pivotal connection means includes a pivotal connection point whereat said fulcrum element and one of said first and second lever member are pivotally connected.

20. A pry device according to claim 19 wherein said pivotal connection point is located substantially within a plane defined by the collar of the lid of the container so that when the first lip portion moves from said first distance to said second distance, said first lip portion and said edge portion of the collar commence movement in a direction substantially tangential to an imaginary radius between said first lip portion engaged with said edge portion of the collar and said pivotal connection point.

21. A pry device according to claim 20 wherein said pivotal connection point is movable along said fulcrum element to adjust said pivotal connection point into a position within said plane defined by the collar of the lid of the container.

22. A pry device adapted for removing a lid from a container of a type having an arcuate upright wall having a curved contour terminating in an upper rim on which a collar of the lid is releasably secured, the upright wall having a flange extending outwardly therefrom at a location proximate to the upper rim, comprising:

(a) a first lever member having a first handle portion and a first lip portion opposite said first handle portion, said first lip portion being arcuately configured to have a common contour with the upright wall and to engage an edge portion of the collar when the lid is secured to the container;

(b) a second lever member having a second handle portion and a second lip portion opposite said second handle portion, said second lip portion being arcuately configured to have a common contour with the upright wall and to engage the flange on the container; and (c) a fulcrum element interconnecting said first and second lever members for relative pivotal movement therebetween so that said first and second lip portions are movable between a contracted position wherein said first and second lip portions are separated a first distance sufficient to respectively engage the edge portion of the collar of the lid and the flange and an expanded position wherein said first and second lip portions are separated a second distance greater than said first distance, said first and second lip portions operative to exert a prying force between the edge portion of the lid and the flange thereby removing the edge portion of the collar of the lid from the rim of the container when the first and second lip portions are moved from said contracted position to said expanded position.

* * * * *